United States Patent [19]

Cohen

[11] Patent Number: 4,886,211

[45] Date of Patent: Dec. 12, 1989

[54] ROTARY SPRINKLERS

[75] Inventor: Amir Cohen, Yuvalium, Israel

[73] Assignees: Agroteam Consultants Ltd. 2, Timrat; Plastro-Gvat, Kibbutz Gvat, both of Israel

[21] Appl. No.: 174,732

[22] Filed: Mar. 29, 1988

[30] Foreign Application Priority Data

May 13, 1987 [IL] Israel ..... 82513

[51] Int. Cl.[4] ..... B05B 3/08

[52] U.S. Cl. ..... 239/222.17; 239/233; 239/246; 239/252; 239/506

[58] Field of Search ..... 239/222.17, 222.21, 239/246, 252, 259, 381, 504, 506, 233; 188/290, 293, 296, 322.5

[56] References Cited

U.S. PATENT DOCUMENTS 4,121,769 10/1978 Drori ..... 239/222.17
4,356,972 11/1982 Vikre ..... 239/222.17
4,440,345 4/1984 Figwer et al. ..... 239/252
4,498,628 2/1985 Tucker ..... 239/381
4,560,108 12/1985 Rubinstein ..... 239/222.17
4,583,689 4/1986 Rosenberg ..... 239/381
4,660,766 4/1987 Nelson et al. ..... 239/222.17
4,796,811 1/1989 Davisson ..... 239/222.17

FOREIGN PATENT DOCUMENTS 476072 11/1952 Italy ..... 239/252

*Primary Examiner*—Andres Kashnikow
*Assistant Examiner*—Michael J. Forman
*Attorney, Agent, or Firm*—Benjamin J. Barish

[57] ABSTRACT

A rotary sprinkler includes a nozzle producing a jet axially of the nozzle, and a rotor configured to deflect the axial jet laterally of the nozzle. The rotor is formed with a socket receiving a pin, and a high viscosity fluid in the rotor socket is effective to apply a retarding force to the rotor during its rotation with respect to the pin.

11 Claims, 2 Drawing Sheets

FIG 1
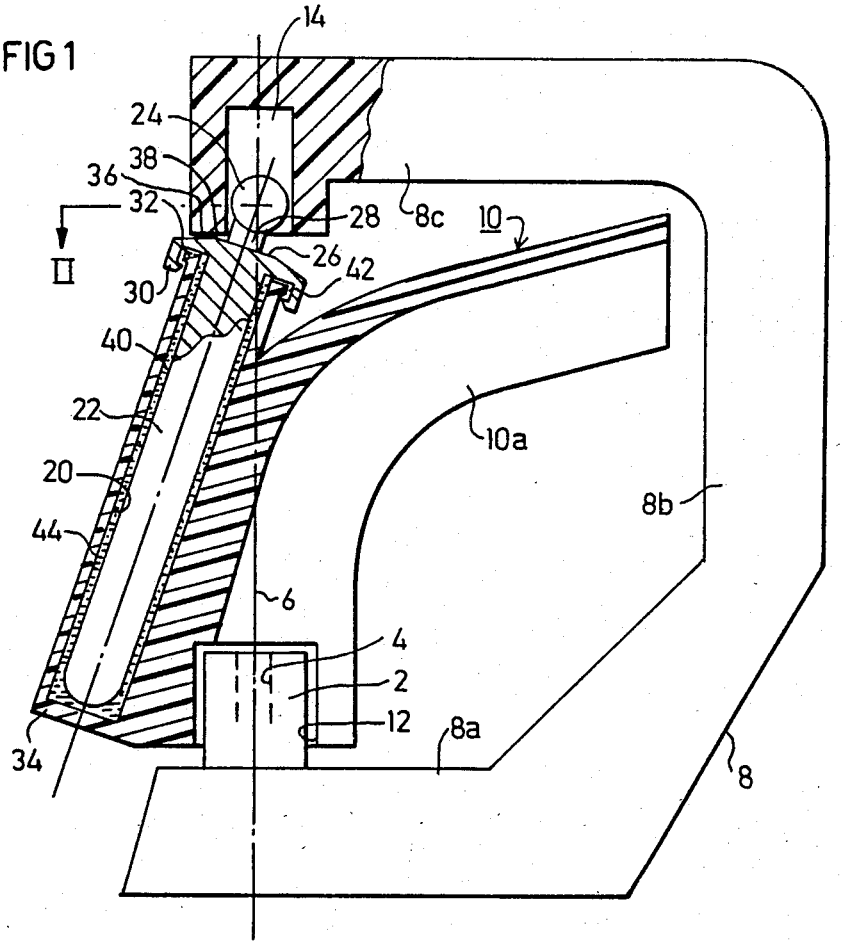
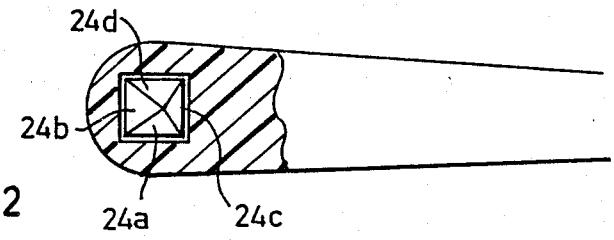
FIG 2
FIG 3
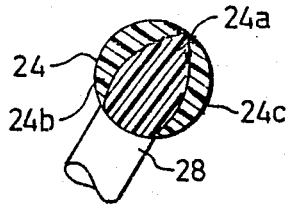

ROTARY SPRINKLERS

BACKGROUND OF THE INVENTION

The present invention relates to rotary sprinklers, such as are used in water irrigation systems for irrigating crops.

A common form of rotary sprinkler includes a nozzle producing a jet axially of the nozzle, a rotor located and configured to receive the axial jet and to deflect it laterally of the nozzle, and a bridge secured to the nozzle and including a leg formed with a socket vertically aligned with the nozzle for rotatably mounting the rotor. Such rotary sprinklers have a tendency for rotating at a high velocity, which decreases the effective range of the sprinkler. These sprinklers are therefore frequently provided with a friction surface, such as a friction ring, between the rotating rotor and the fixed nozzle to retard or brake the rotor. However, such friction surfaces are not completely satisfactory since the retarding effect imparted by them tends to change in the course of time as the surfaces wear, thereby requiring frequent adjustment or replacement of sprinkler parts.

An object of the present invention is to provide a rotary sprinkler of the foregoing type which includes an improved arrangement for retarding the rotation of the rotor.

BRIEF SUMMARY OF THE INVENTION

According to the present invention, there is provided a rotary sprinkler including a nozzle producing a jet axially of the nozzle; a rotor rotatably mounted at one end of the nozzle and configured to receive the axial jet and to deflect it laterally of the nozzle, the rotor also being axially movable with respect to the nozzle so as to close the nozzle opening when the sprinkler is not operating; a bridge secured to the nozzle and including a leg formed with a socket vertically aligned with the nozzle; and a pin having a head at one end non-rotatably received within the bridge socket. The rotor is formed with a socket receiving the pin and rotatable with respect thereto. The sprinkler further includes a high viscosity fluid in the rotor socket effective to apply a retarding force to the rotor during its rotation with respect to the pin.

While it is known, in sprinklers of the rotary nozzle type such as illustrated in U.S. Pat. No. 4,440,345, to provide a highly-viscous fluid in a cavity between the rotating nozzle and a stationary housing in order to retard the rotation of the nozzle, the construction in such sprinklers is such that the retarding effect is substantially smaller than that obtained in the sprinklers of the present application.

Two embodiments of the invention are described below for purposes of example. In one described embodiment, the rotor socket is inclined at an acute angle with respect to the axis of the nozzle and bridge socket; and in a second described embodiment, the rotor socket is coaxial with the axis of the nozzle and bridge socket.

The foregoing features enable the construction of rotary sprinklers in which the retarding effect is relatively high so that the rotor rotates at a relatively slow speed thereby increasing the range of the sprinkler, and in which the retarding effect also remains relatively constant over long periods of use thereby substantially decreasing maintenance and replacement costs.

Further features of the invention will be apparent from the description below.

BRIEF DESCRIPTION OF THE DRAWINGS

The invention is herein described, by way of example only, with reference to the accompanying drawings, wherein:

FIG. 1 is a side elevational view, partly in section, illustrating one form of rotary sprinkler constructed in accordance with the present invention;

FIG. 2 is a sectional view along lines II—II of FIG. 1;

FIG. 3 is an enlarged fragmentary view illustrating the head of the pin used for mounting the rotor in the rotary sprinkler of FIG. 1;

DESCRIPTION OF PREFERRED EMBODIMENTS

Figure 4:
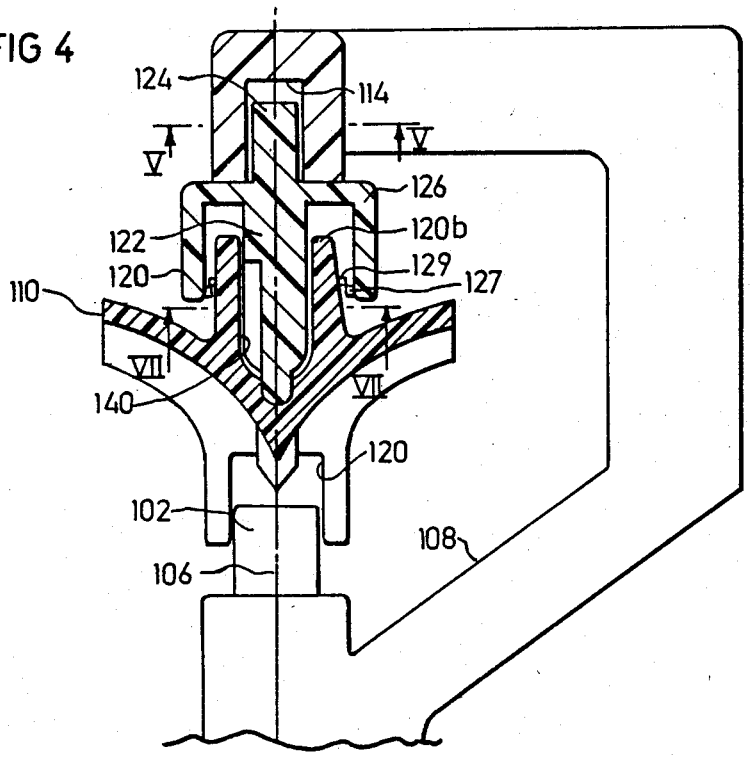
FIG. 4 is a side elevational view, partly in section, illustrating another form of rotary sprinkler constructed in accordance with the present invention.

The rotary sprinkler illustrated in FIGS. 1–3 of the drawings comprises a nozzle 2 of outer cylindrical configuration connectable to a source of pressurized water and formed with a through-going bore 4 for producing a jet parallel to the axis 6 of the nozzle. In the conventional manner of using the illustrated rotary sprinkler, nozzle 2 is mounted so that the axis 6 of the nozzle extends vertically, as shown in FIG. 1.

The illustrated sprinkler further includes a bridge, generally designated 8, having a lower horizontal leg 8*a* secured to nozzle 2, a vertical leg 8*b* laterally of the nozzle, and an upper horizontal leg 8*c* spaced above the nozzle. The illustrated sprinkler further includes a rotor 10 rotatably mounted between nozzle 2 and leg 8*c* of the bridge. For this purpose, the lower end of rotor 10 is formed with a socket 12 rotatably receiving nozzle 10, and bridge leg 8*c* is also formed with a socket 14 rotatably receiving the rotor. The two sockets 12 and 14 are in alignment with each other and also with the axis 6 of nozzle bore 4.

Socket 12 of rotor 10 also floatingly mounts the rotor on nozzle 2, permitting the rotor to move axially, as well as rotatably, with respect to the nozzle. Thus, when the sprinkler is not operating, rotor 10 rests, by its own weight, against the upper face of nozzle 2 so as to close the nozzle bore 4 against the entry of insects, dirt, or the like; and when the nozzle is operating, the pressurized water discharged via bore 4 of the nozzle raises the rotor 10 and rotates it about axis 6.

The underface of rotor 10 is formed with a channel or groove 10*a* of curved configuration extending through an arc of approximately 90°, such that the lower end of the groove is aligned with the nozzle bore 4, and the upper end of the groove extends subtantially horizontally, or with a slight upward incline to the horizontal. The underface of rotor 10 thus receives the jet issuing axially from nozzle 2 and deflects it laterally of the nozzle, while the jet rotates the rotor.

In the conventional rotary sprinkler of this type, the rotor is rotatably mounted with respect to the bridge socket (14 of bridge leg 8*c*) by a stem received within socket 14 and extending substantially parallel to its axis and to the axis of nozzle 2. However, as mentioned earlier, the rotor in such sprinklers tends to rotate very rapidly, thereby substantially decreasing the range of the sprinkler. As described above, in order to retard or brake the rotation of the rotor, conventional sprinklers frequently include a friction ring, or other friction surface, acting between the rotor and bridge 8 of nozzle 2. In the sprinkler illustrated in FIGS. 1–3 of the drawings, the retarding or braking of the rotor is effected in a different and more effective manner.

Thus, rotor 10 is formed, for substantially its complete length, with an elongated socket 20 which is inclined at an acute angle with respect to the axis 6 of nozzle 2 and the bridge socket 14. The sprinkler further includes an elongated pin 22 received in socket 20 and having a head 24 non-rotatably received within bridge socket 14. Preferably, the incline of the axis of socket 20 and pin 22 is from 20°–50° to the axis 6 of the nozzle 2 and of socket 14; a preferred inclination is about 30°.

Pin 22 is integrally formed with a cap 26 and a stem 28 connecting the pin to its head 24. Cap 26 is formed with a depending rim 30 which snaps-over an annular rib 32 formed in the outer face of the open end of socket 20; the opposite end 34 of the socket is closed. The outer face of cap 26 is of tapered or conical configuration, as indicated at 36, to mate with the outer side of the underface 38 of bridge leg 8*c*. In the illustrated inclined position of the pin 24 and cap 26, this limits the penetration of pin head 24 into socket 14 which thereby limits the upward axial movement of the rotor 10 with respect to the nozzle 2 during the operation of the sprinkler.

Pin head 24 is of generally spherical configuration but is flattened on its four sides, as shown at 24*a*–24*d* (FIGS. 2, 3). This permits the pin 24 to oscillate about the horizontal axis (i.e., the axis perpendicular to nozzle axis 6), but not to rotate about the nozzle axis 6.

Socket 20 is filled with a highly-viscous liquid 40, such as silicone oil. Thus, during the operation of the sprinkler, rotor 10 rotates above nozzle axis 6, and carries with it socket 20 which also rotates about nozzle axis 6. This rotation of the rotor socket 20 is permitted by pin 22; that is pin head 24 does not rotate but rather oscillates within socket 14 about the horizontal axis 39. During this rotation of the rotor socket 20 about pin 22, the highly-viscous liquid 40 disposed within the socket acts to retard or brake the rotation of the rotor 10 about nozzle 2.

As shown in FIG. 2, the high-viscosity fluid 40 completely fills socket 20 including the space 42 between the upper end of the socket and the lower face of cap 26. The foregoing parts are preferably dimensioned so that space 42 between the upper end of socket 20 and the inner face of cap 26 is substantially smaller than the space 44 between the inner face of socket 20 and the outer face of pin 22. This arrangement prevents leaking of the highly-viscous fluid 40 out of socket 20, and the penetration of air into the socket, not only during the operation of the sprinkler, but also during its storage or transportation. Accordingly, the illustrated arrangement provides a self-contained, self-sealed unit without the need for O-rings or other seals.

During the operation of the sprinkler, the water jet, leaving nozzle 2 along its axis 6, tends to raise rotor 10. The raising of the rotor is limited by conical face 36 of cap 26 against the outer side of the face 38 of bridge leg 8*c* bordering its recess 14, and/or by contact of the inner face of the bottom wall of socket 20 with the tip of pin 22. The tip of the pin is preferably rounded for this purpose as shown in FIG. 1 of the drawings. Thus, the wear and tear during use of the sprinkler is substantially limited to one or both of these points of possible contact.

FIG. 4 illustrates another construction of rotary sprinkler, including a nozzle 102 of outer cylindrical configuration producing a jet parallel to the axis 106 of the nozzle; a bridge 108 secured to the nozzle; and a rotor 110 floatingly mounted on the nozzle for both rotable and axial movements with respect to the nozzle, as described in FIG. 1. As also described in FIG. 1, the upper horizontal leg of bridge 108 is formed with a socket 114 in alignment with axis 106 of the nozzle; in addition, rotor 110 is formed with a socket 120 rotatable with respect to a pin 122 received in the rotor socket 120, the pin being formed at its opposite end with a head 124 non-rotatably received within the bridge socket 114.

However, in the embodiment illustrated in FIG. 4, rotor socket 120 is not inclined with respect to axis 106 of nozzle 102 and bridge socket 114, but rather is coaxial with respect to this axis 106; in addition, the structure of pin 122 is quite different from that of pin 22 in FIG. 1.

Figure 5:
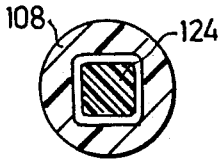
FIG. 5 is a sectional view along lines V—V of FIG. 4.

Thus, as shown in FIG. 5, both the bridge socket 114 and head 124 of pin 122 are of generally square cross-section. This construction permits pin 122 to move axially, but not to rotate, with respect to bridge socket 114 and nozzle 102.

Figure 7A:
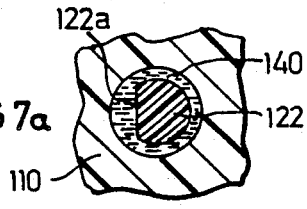
FIG. 7*a* is a sectional view along line VII—VII of FIG. 4.
Figure 7B:
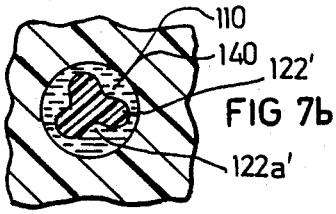
FIG. 7*b* illustrates a variation in the construction shown in FIG. 7*a*

In addition, the lower end of pin 122 received within rotor socket 120, is of non-cylindrical configuration so as to increase the retarding effect produced by the high-viscosity fluid 140 within the socket. FIG. 7*a* illustrates one construction of pin 122 for this purpose wherein it will be seen that the pin includes a flat side 122*a*. FIG. 7*b* illustrates an alternative construction, wherein the pin 122' is formed with a plurality (three being illustrated) axially-extending recesses 122*a'* for increasing the retarding effect produced by the high-viscosity fluid 140.

Figure 6A:
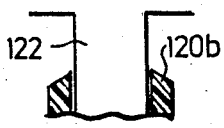
FIG. 6*a* is a fragmentary view illustrating the structure at the upper end of the rotor socket in FIG. 4.
Figure 6B:
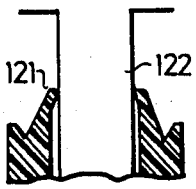
FIGS. 6*b* and 6*c* are fragmentary views illustrating variations in the construction shown in FIG. 6*a;*
Figure 6C:
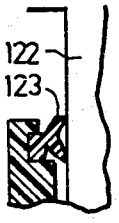

FIG. 6*a* illustrates the upper end 120*b* of socket 120, wherein it will be seen that this upper end is closely spaced to pin 122 so as to prevent leakage of the high viscosity fluid from the socket. FIG. 6*b* illustrates a variation wherein the upper end of the rotor socket 120 is formed with a lip 121 bearing against pin 122 so as to more effectively seal the fluid within the socket; and FIG. 6*c* illustrates a further variation wherein the upper end of the socket is provided with a sealing ring 123 which prevents leakage of the high viscosity fluid from the socket during the operation of the sprinkler.

Pin 122 is formed with a cap 126 enclosing the upper end of the rotor socket 120. If desired, cap 126 may be formed with an annular rib 127 at its outer end snappable over an annular rib 129 formed in the rotor socket 120 so as to retain pin 122 attached to the rotor. However, this is not essential since the upper horizontal leg of bridge 108 formed with the bridge socket 114 will prevent the separation of the rotor and pin from the nozzle 102 during the operation of the sprinkler.

It will be seen that the sprinkler illustrated in FIG. 4 will operate in substantially the same manner as in FIG.

3, except that the retarding of the rotation of the rotor will be effected by the highly-viscous fluid 140 between the axial pin 122 and rotor socket 120, rather than between the inclined pin (22) and its rotor socket.

It will be noted that the FIG. 1 embodiment of the invention is a single-jet sprinkler, while that of FIG. 4 is a dual-jet sprinkler. It will be appreciated, however, that such embodiments are set forth merely for illustration purposes, and that many other variations, modifications and applications of this invention may be made.

What is claimed is:

1. A rotary sprinkler including a nozzle producing a jet axially of the nozzle; a rotor; a pin rotatably mounting said rotor at one end of said nozzle; said rotor being formed with a groove configured to receive the axial jet and to deflect it laterally of the nozzle; said rotor also being formed with a socket receiving said pin so as to be rotatable with respect thereto and also to be axially movable with respect to said nozzle so as to close the nozzle opening when the sprinkler is not operating; a bridge secured to the nozzle and including a leg formed with a socket vertically aligned with the nozzle; said pin having a head at one end non-rotatably received within said bridge socket; said rotor socket being inclined at an acute angle with respect to the axis of the nozzle and bridge socket; and a high viscosity fluid in said rotor socket effective to apply a retarding force to the rotor during its rotation with respect to said pin.

2. The sprinkler according to claim 1, wherein said pin includes a cap integrally formed with said head for closing the upper end of said rotor socket.

3. The sprinkler according to claim 2, wherein said rotor socket is closed at the bottom, is open at the top, and is formed with an outer annular rib around its open top, said cap being formed with an outer rim snappable over said annular rib of the rotor socket for assembling the pin to the rotor socket.

4. The sprinkler according to claim 3, wherein said cap is dimensioned so as to be engageable with said bridge leg formed with the bridge socket, and thereby to limit the axial position of the pin head within the bridge socket during the operation of the sprinkler.

5. The sprinkler according to claim 4, wherein the cap has an outer face formed with an inclined surface mating with the outer surface of said bridge leg in the inclined position of the pin.

6. The sprinkler according to claim 1, wherein said rotor socket extends for substantially the complete height of the rotor, and is inclined at an angle of 20°–50° with respect to the axis of the nozzle and bridge socket.

7. The sprinkler according to claim 6, wherein said rotor socket is inclined approximately 30° with respect to the axis of the nozzle and bridge socket.

8. The sprinkler according to claim 1, wherein said bridge socket is of square configuration, and said head of the pin is of spherical configuration but flattened on four sides so as to permit the pin to oscillate about an axis perpendicular to the nozzle axis but not to rotate about the nozzle axis.

9. The sprinkler according to claim 1, wherein said rotor socket is closed at its bottom, and said pin is rounded at its bottom facing the closed bottom of the rotor socket.

10. the sprinkler according to claim 1, wherein said rotor includes a second socket facing and receiving said nozzle.

11. The sprinkler according to claim 1, wherein both said rotor socket and said pin are of generally cylindrical configuration.

* * * * *